US011322095B1

(12) United States Patent
Zhuang et al.

(10) Patent No.: US 11,322,095 B1
(45) Date of Patent: May 3, 2022

(54) GATE DRIVING WITH PROGRESSIVE SCANNING AND INTERLACED SCANNING IN DIFFERENT PORTIONS OF DISPLAY DEVICE

(71) Applicant: Facebook Technologies, LLC, Menlo Park, CA (US)

(72) Inventors: Zhiming Zhuang, Sammamish, WA (US); Min Hyuk Choi, San Jose, CA (US); Donghee Nam, San Jose, CA (US); Wonjae Choi, San Jose, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/194,025

(22) Filed: Mar. 5, 2021

(51) Int. Cl.
*G09G 3/3266* (2016.01)

(52) U.S. Cl.
CPC ... *G09G 3/3266* (2013.01); *G09G 2310/0224* (2013.01); *G09G 2310/08* (2013.01); *G09G 2320/0223* (2013.01)

(58) Field of Classification Search
CPC ..... G09G 3/3266; G09G 2310/08; G09G 2310/0224; G09G 2320/0223
See application file for complete search history.

(56) References Cited

U.S. PATENT DOCUMENTS

2006/0152459 A1* 7/2006 Shin ..... G09G 3/20 345/94
2011/0164017 A1* 7/2011 Chung ..... G09G 3/3674 345/211
2011/0187691 A1* 8/2011 Chung ..... G09G 5/00 345/211
2016/0232831 A1* 8/2016 Nakanishi ..... G09G 3/2007

* cited by examiner

*Primary Examiner* — Christopher J Kohlman
(74) *Attorney, Agent, or Firm* — Fenwick & West LLP

(57) ABSTRACT

Embodiments relate to a display device including an active display area with pixels arranged in rows and columns, where a focus area of the active display area is operated in a progressive scanning manner and a non-focus area of the active display area is operated in an interlaced scanning manner. The active display area is driven by a gate driver circuit that supplies gate signals the pixels. First stages of the gate driver circuit are coupled to first rows of the pixels that are in the focus area and output first gate signals in the progressive scanning manner. Second stages of the gate driver circuit are coupled to second rows of the pixels that are in the non-focus area and output second gate signals in the interlaced scanning manner.

20 Claims, 10 Drawing Sheets

300

Even Frame Operation

Odd Frame Operation

GATE DRIVING WITH PROGRESSIVE SCANNING AND INTERLACED SCANNING IN DIFFERENT PORTIONS OF DISPLAY DEVICE

BACKGROUND

This disclosure relates to a display device, and specifically to driving different portions of a display device in a progressive scanning manner and an interlaced scanning manner.

A display device is often used in a virtual reality (VR) or augmented-reality (AR) system as a head-mounted display (HMD) or a near-eye display (NED). To display high resolution images, it is beneficial to increase the number of pixels in the display device and operate the display device with a higher frame rate. However, when there is an increased number of pixels in a display device being operated at a higher frame rate, time allocated for charging the pixels with data voltage may be insufficient, which could lead to deteriorated image quality. Additionally, with increasing number of pixels, the RC loading for each row of pixels connected to a gate line increases. The increased RC loading leads to a longer period of time to charge the row of pixels to expected data voltage, causing further challenges to maintain a high frame rate.

SUMMARY

Embodiments relate to a display device including an active display area with pixels arranged into rows and columns, where the active display area is divided into a focus area and a non-focus area. The focus area may correspond to a center region associated with first rows of pixels and first columns of pixels, and the non-focus area may correspond to a peripheral region surrounding the center region associated with second rows of pixels and second columns of pixels. A gate driver of the display device is coupled to gate lines that supply gate signals to the pixels in the active display area. First stages of the gate driver output first gate signals to the first rows of the pixels in a progressive scanning manner while second stages of the gate driver output second gate signals to the second rows of the pixels in an interlaced scanning manner. A source driver circuit refreshes a first subset of data signals to the first columns of the pixels at a first rate and refreshes a second subset of data signals to the second columns of the pixels at a second rate that is less than the first rate.

The figures depict embodiments of the present disclosure for purposes of illustration only.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, the described embodiments may be practiced without these specific details. In other instances, well-known methods, procedures, components, circuits, and networks have not been described in detail so as not to unnecessarily obscure aspects of the embodiments.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Near-Eye Display

Figure 1:
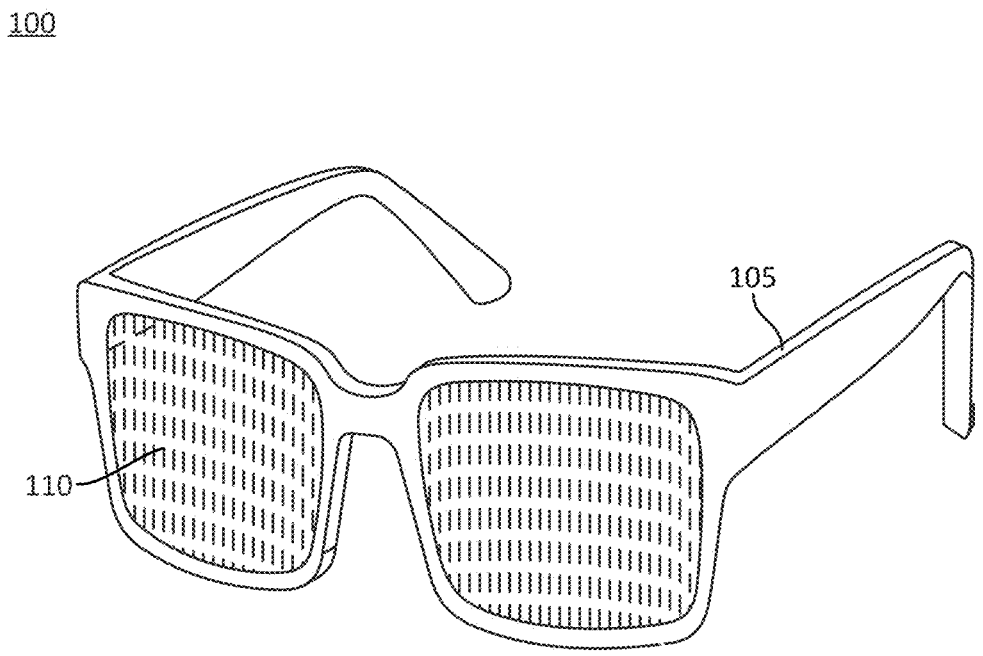
FIG. 1 is a diagram of a head-mounted display (HMD) that includes a near-eye display (NED), according to some embodiments.

FIG. 1 is a diagram of a near-eye-display (NED) 100, in accordance with some embodiments. The NED 100 may present media to a user. Examples of media that may be presented by the NED 100 include one or more images, video, audio, or some combination thereof. In some embodiments, audio may be presented via an external device (e.g., speakers and/or headphones) that receives audio information from the NED 100, a console (not shown), or both, and presents audio data to the user based on the audio information. The NED 100 is generally configured to operate as a virtual reality (VR) NED. However, in some embodiments, the NED 100 may be modified to also operate as an augmented reality (AR) NED, a mixed reality (MR) NED, or some combination thereof. For example, in some embodiments, the NED 100 may augment views of a physical, real-world environment with computer-generated elements (e.g., still images, video, sound, etc.).

The NED 100 shown in FIG. 1 may include a frame 105 and a display 110. The frame 105 may include one or more optical elements that together display media to a user. That is, the display 110 may be configured for a user to view the content presented by the NED 100. As discussed below in conjunction with FIG. 2, the display 110 may include at least one source assembly to generate image light to present optical media to an eye of the user. The source assembly may include, e.g., a source, an optics system, or some combination thereof.

FIG. 1 is merely an example of a virtual reality system, and the display systems described herein may be incorporated into further such systems. In some embodiments, FIG. 1 may also be referred to as a Head-Mounted-Display (HMD).

Figure 2:
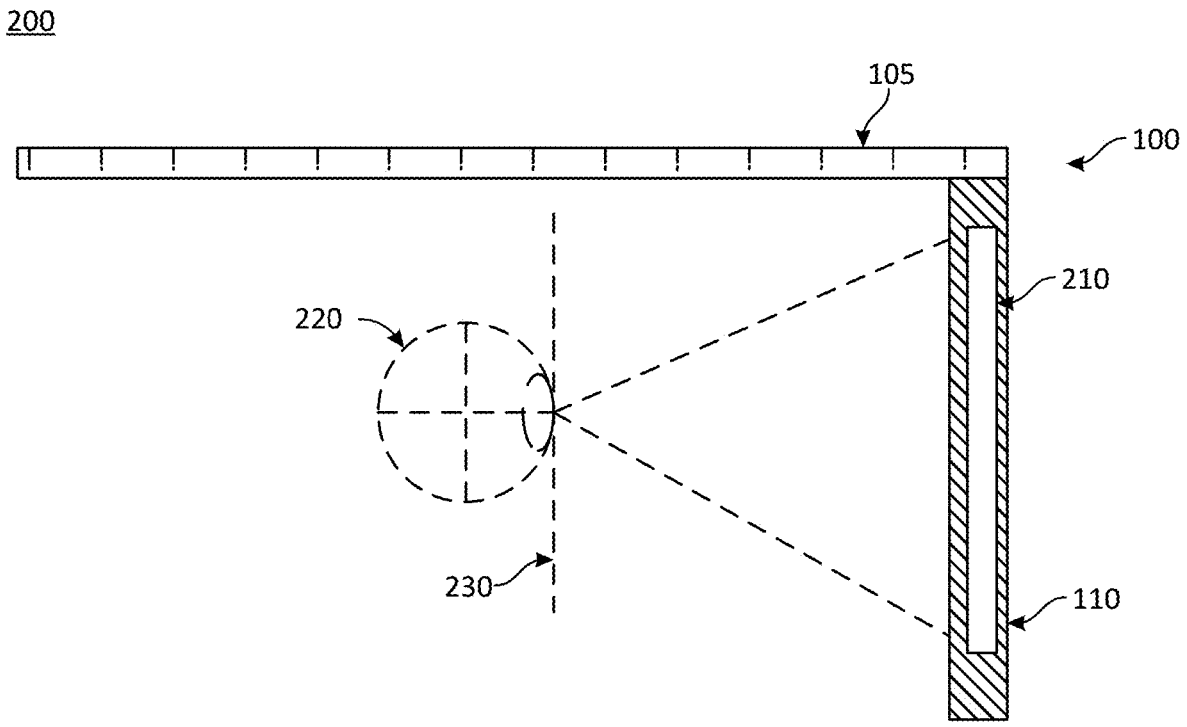
FIG. 2 is a cross-sectional view of the HMD illustrated in FIG. 1, according to some embodiments.

FIG. 2 is a cross section 200 of the NED 100 illustrated in FIG. 1, in accordance with some embodiments of the present disclosure. The cross section 200 may include at least one display assembly 210, and an exit pupil 230. The exit pupil 230 is a location where the eye 220 may be positioned when the user wears the NED 100. In some embodiments, the frame 105 may represent a frame of eye-wear glasses. For purposes of illustration, FIG. 2 shows the cross section 200 associated with a single eye 220 and a single display assembly 210, but in alternative embodiments not shown, another display assembly that is separate from or integrated with the display assembly 210 shown in FIG. 2, may provide image light to another eye of the user.

The display assembly 210 may direct the image light to the eye 220 through the exit pupil 230. The display assembly 210 may be composed of one or more materials (e.g., plastic, glass, etc.) with one or more refractive indices that effectively decrease the weight and widen a field of view of the NED 100.

In alternate configurations, the NED 100 may include one or more optical elements (not shown) between the display assembly 210 and the eye 220. The optical elements may act to, by way of various examples, correct aberrations in image light emitted from the display assembly 210, magnify image light emitted from the display assembly 210, perform some other optical adjustment of image light emitted from the display assembly 210, or combinations thereof. Example optical elements may include an aperture, a Fresnel lens, a convex lens, a concave lens, a filter, or any other suitable optical element that may affect image light.

In some embodiments, the display assembly 210 may include a source assembly to generate image light to present media to a user's eyes. The source assembly may include, e.g., a light source, an optics system, or some combination thereof. In accordance with various embodiments, a source assembly may include a light-emitting diode (LED) such as an organic light-emitting diode (OLED).

Figure 3:
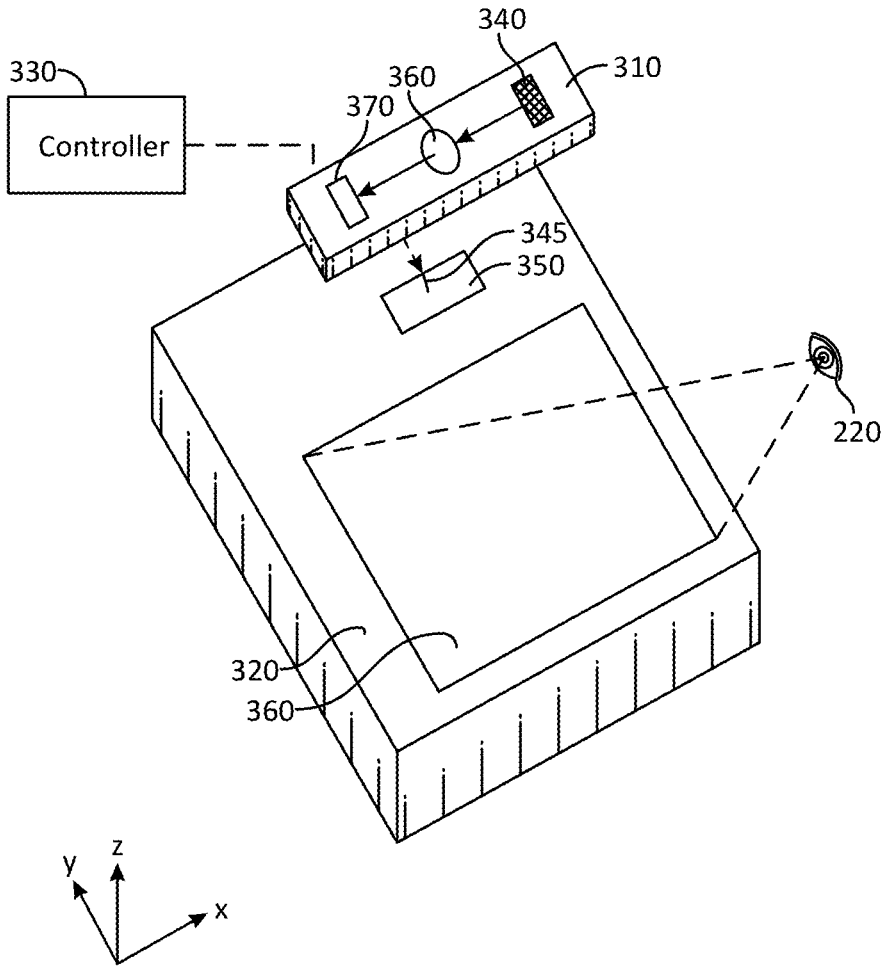
FIG. 3 illustrates a perspective view of a waveguide display, according to some embodiments.

FIG. 3 illustrates a perspective view of a waveguide display 300 in accordance with some embodiments. The waveguide display 300 may be a component (e.g., display assembly 210) of NED 100. In alternate embodiments, the waveguide display 300 may constitute a part of some other NED, or other system that directs display image light to a particular location.

The waveguide display 300 may include, among other components, a source assembly 310, an output waveguide 320, and a controller 330. For purposes of illustration, FIG. 3 shows the waveguide display 300 associated with a single eye 220, but in some embodiments, another waveguide display separate (or partially separate) from the waveguide display 300 may provide image light to another eye of the user. In a partially separate system, for instance, one or more components may be shared between waveguide displays for each eye.

The source assembly 310 generates image light. The source assembly 310 may include a source 340, a light conditioning assembly 360, and a scanning mirror assembly 370. The source assembly 310 may generate and output image light 345 to a coupling element 350 of the output waveguide 320.

The source 340 may include a source of light that generates at least a coherent or partially coherent image light 345. The source 340 may emit light in accordance with one or more illumination parameters received from the controller 330. The source 340 may include one or more source elements, including, but not restricted to light emitting diodes, such as micro-OLEDs, as described in detail below with reference to FIGS. 4-10.

The output waveguide 320 may be configured as an optical waveguide that outputs image light to an eye 220 of a user. The output waveguide 320 receives the image light 345 through one or more coupling elements 350 and guides the received input image light 345 to one or more decoupling elements 360. In some embodiments, the coupling element 350 couples the image light 345 from the source assembly 310 into the output waveguide 320. The coupling element 350 may be or include a diffraction grating, a holographic grating, some other element that couples the image light 345 into the output waveguide 320, or some combination thereof. For example, in embodiments where the coupling element 350 is a diffraction grating, the pitch of the diffraction grating may be chosen such that total internal reflection occurs, and the image light 345 propagates internally toward the decoupling element 360. For example, the pitch of the diffraction grating may be in the range of approximately 300 nm to approximately 600 nm.

The decoupling element 360 decouples the total internally reflected image light from the output waveguide 320. The decoupling element 360 may be or include a diffraction grating, a holographic grating, some other element that decouples image light out of the output waveguide 320, or some combination thereof. For example, in embodiments where the decoupling element 360 is a diffraction grating, the pitch of the diffraction grating may be chosen to cause incident image light to exit the output waveguide 320. An orientation and position of the image light exiting from the output waveguide 320 may be controlled by changing an orientation and position of the image light 345 entering the coupling element 350.

The output waveguide 320 may be composed of one or more materials that facilitate total internal reflection of the image light 345. The output waveguide 320 may be composed of, for example, silicon, glass, or a polymer, or some combination thereof. The output waveguide 320 may have a relatively small form factor such as for use in a head-mounted display. For example, the output waveguide 320 may be approximately 30 mm wide along an x-dimension, 50 mm long along a y-dimension, and 0.5-1 mm thick along a z-dimension. In some embodiments, the output waveguide 320 may be a planar (2D) optical waveguide.

The controller 330 may be used to control the scanning operations of the source assembly 310. In certain embodiments, the controller 330 may determine scanning instructions for the source assembly 310 based at least on one or more display instructions. Display instructions may include instructions to render one or more images. In some embodiments, display instructions may include an image file (e.g., bitmap). The display instructions may be received from, e.g., a console of a virtual reality system (not shown). Scanning instructions may include instructions used by the source assembly 310 to generate image light 345. The scanning instructions may include, e.g., a type of a source of image light (e.g. monochromatic, polychromatic), a scanning rate, an orientation of scanning mirror assembly 370, and/or one or more illumination parameters, etc. The controller 330 may include a combination of hardware, software, and/or firmware not shown here so as not to obscure other aspects of the disclosure.

According to some embodiments, source 340 may include a light emitting diode (LED), such as an organic light emitting diode (OLED). An organic light-emitting diode (OLED) is a light-emitting diode (LED) having an emissive electroluminescent layer that may include a thin film of an organic compound that emits light in response to an electric current. The organic layer is typically situated between a pair of conductive electrodes. One or both of the electrodes may be transparent.

As will be appreciated, an OLED display can be driven with a passive-matrix (PMOLED) or active-matrix (AMOLED) control scheme. In a PMOLED scheme, each row (and line) in the display may be controlled sequentially, whereas AMOLED control typically uses a thin-film transistor backplane to directly access and switch each individual pixel on or off, which allows for higher resolution and larger display areas.

Figure 4:
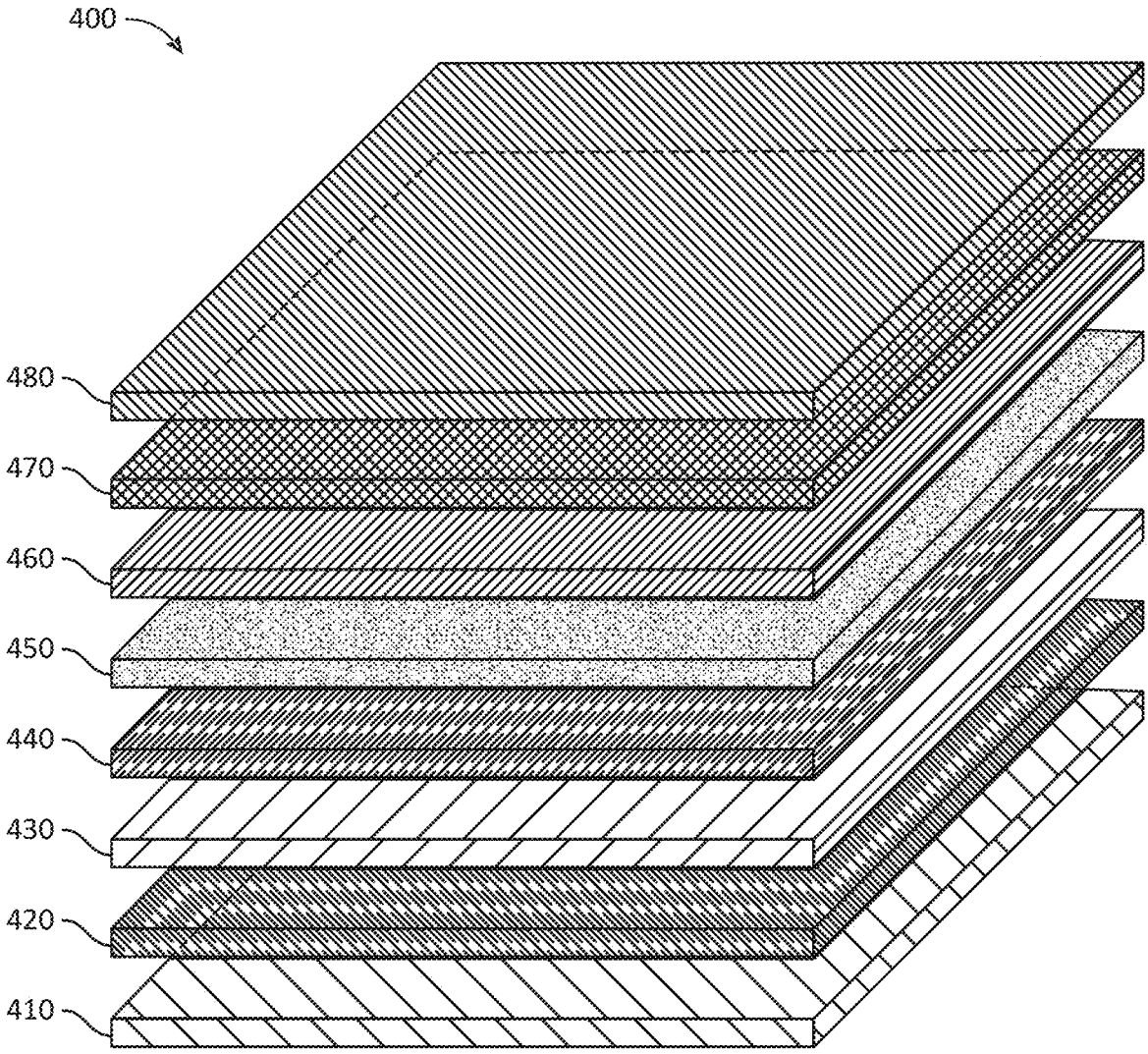
FIG. 4 depicts a simplified OLED structure, according to some embodiments.

FIG. 4 depicts a simplified OLED structure according to some embodiments. As shown in an exploded view, OLED 400 may include, from bottom to top, a substrate 410, anode 420, hole injection layer 430, hole transport layer 440, emissive layer 450, blocking layer 460, electron transport layer 470, and cathode 480. In some embodiments, substrate (or backplane) 410 may include single crystal or polycrystalline silicon or other suitable semiconductor (e.g., germanium).

Anode 420 and cathode 480 may include any suitable conductive material(s), such as transparent conductive oxides (TCOs, e.g., indium tin oxide (ITO), zinc oxide (ZnO), and the like). The anode 420 and cathode 480 are configured to inject holes and electrons, respectively, into one or more organic layer(s) within emissive layer 450 during operation of the device.

The hole injection layer 430, which is disposed over the anode 420, receives holes from the anode 420 and is configured to inject the holes deeper into the device, while the adjacent hole transport layer 440 may support the transport of holes to the emissive layer 450. The emissive layer 450 converts electrical energy to light. Emissive layer 450 may include one or more organic molecules, or light-emitting fluorescent dyes or dopants, which may be dispersed in a suitable matrix as known to those skilled in the art.

Blocking layer 460 may improve device function by confining electrons (charge carriers) to the emissive layer 450. Electron transport layer 470 may support the transport of electrons from the cathode 480 to the emissive layer 450.

In some embodiments, the generation of red, green, and blue light (to render full-color images) may include the formation of red, green, and blue OLED sub-pixels in each pixel of the display. Alternatively, the OLED 400 may be adapted to produce white light in each pixel. The white light may be passed through a color filter to produce red, green, and blue sub-pixels.

Any suitable deposition process(es) may be used to form OLED 400. For example, one or more of the layers constituting the OLED may be fabricated using physical vapor deposition (PVD), chemical vapor deposition (CVD), evaporation, spray-coating, spin-coating, atomic layer deposition (ALD), and the like. In further aspects, OLED 400 may be manufactured using a thermal evaporator, a sputtering system, printing, stamping, etc.

According to some embodiments, OLED 400 may be a micro-OLED. A "micro-OLED," in accordance with various examples, may refer to a particular type of OLED having a small active light emitting area (e.g., less than 2,000 μm2 in some embodiments, less than 20 μm2 or less than 10 μm2 in other embodiments). In some embodiments, the emissive surface of the micro-OLED may have a diameter of less than approximately 2 μm. Such a micro-OLED may also have collimated light output, which may increase the brightness level of light emitted from the small active light emitting area.

Figure 5:
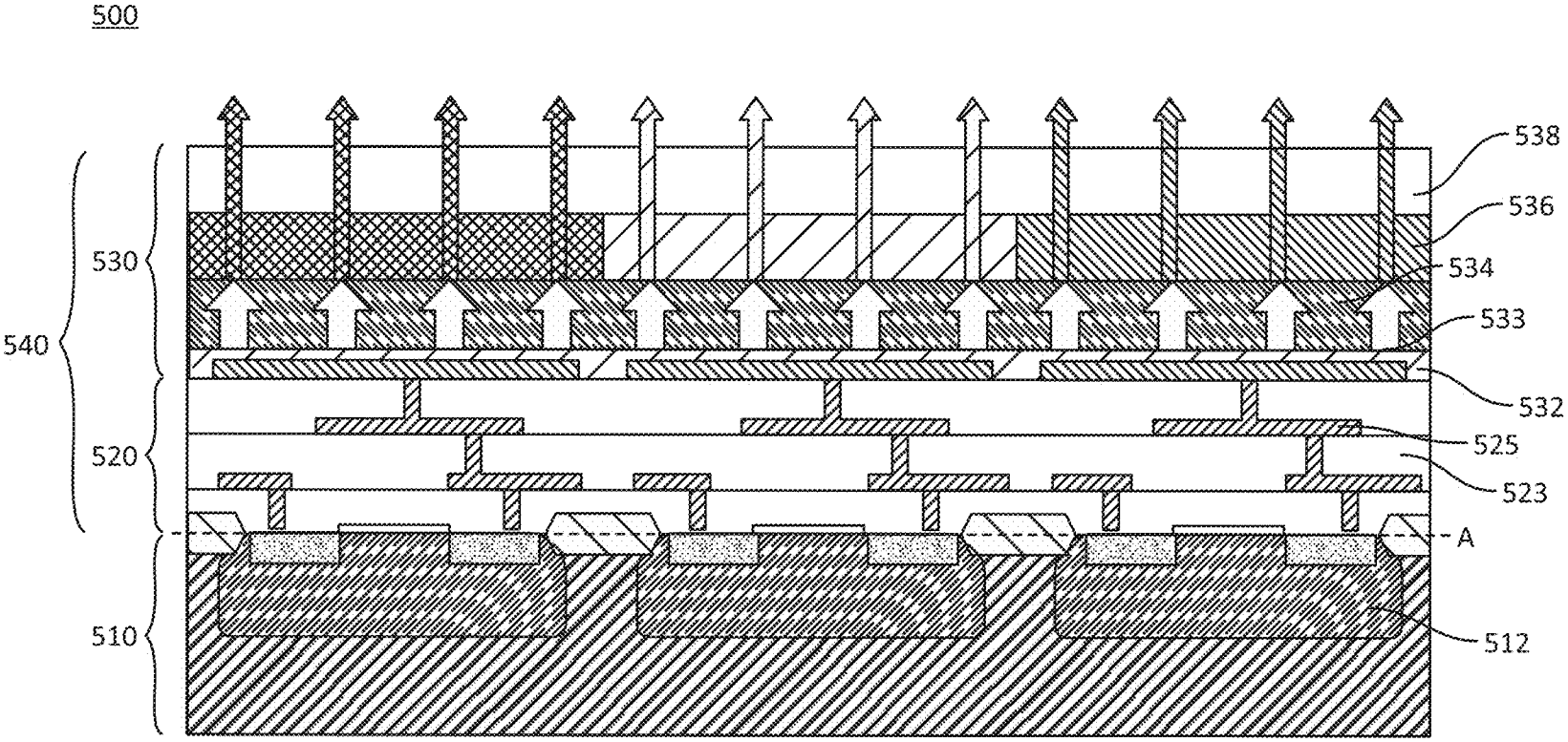
FIG. 5 is a schematic view of an OLED display device architecture including a display driver integrated circuit (DDIC), according to some embodiments.

FIG. 5 is a schematic view of an OLED display device architecture including a display driver integrated circuit (DDIC) 510 according to some embodiments. According to some embodiments, OLED display device 500 (e.g., micro-OLED chip) may include an active display area 530 having an active matrix 532 (such as OLED 400) disposed over a single crystal (e.g., silicon) backplane 520. The combined display/backplane architecture, i.e., display element 540 may be bonded (e.g., at or about interface A) directly or indirectly to the DDIC 510. As illustrated in FIG. 5, DDIC 510 may include an array of driving transistors 512, which may be formed using conventional CMOS processing. One or more display driver integrated circuits may be formed over a single crystal (e.g., silicon) substrate.

In some embodiments, the active display area 530 may have at least one areal dimension (i.e., length or width) greater than approximately 1.3 inches, e.g., approximately 1.4, 1.5, 1.6, 1.7, 1.8, 1.9, 2.0, 2.25, 2.5, 2.75, or 3 inches, including ranges between any of the foregoing values, although larger area displays are contemplated.

Backplane 520 may include a single crystal or polycrystalline silicon layer 523 having a through silicon via 525 for electrically connecting the DDIC 510 with the active display area 530. In some embodiments, active display area 530 may further include a transparent encapsulation layer 534 disposed over an upper emissive surface 533 of active matrix 532, a color filter 536, and cover glass 538.

According to various embodiments, the active display area 530 and underlying backplane 520 may be manufactured separately from, and then later bonded to, DDIC 510, which may simplify formation of the OLED active area, including formation of the active matrix 532, color filter 536, etc.

The DDIC 510 may be directly bonded to a back face of the backplane opposite to active matrix 532. In further embodiments, a chip-on-flex (COF) packaging technology may be used to integrate display element 540 with DDIC 510, optionally via a data selector (i.e., multiplexer) array (not shown) to form OLED display device 500. As used herein, the terms "multiplexer" or "data selector" may, in some examples, refer to a device adapted to combine or select from among plural analog or digital input signals, which are transmitted to a single output. Multiplexers may be used to increase the amount of data that can be communicated within a certain amount of space, time, and bandwidth.

As used herein, "chip-on-flex" (COF) may, in some examples, refer to an assembly technology where a microchip or die, such as an OLED chip, is directly mounted on and electrically connected to a flexible circuit, such as a direct driver circuit. In a COF assembly, the microchip may avoid some of the traditional assembly steps used for individual IC packaging. This may simplify the overall processes of design and manufacture while improving performance and yield.

In accordance with certain embodiments, assembly of the COF may include attaching a die to a flexible substrate, electrically connecting the chip to the flex circuit, and encapsulating the chip and wires, e.g., using an epoxy resin to provide environmental protection. In some embodiments, the adhesive (not shown) used to bond the chip to the flex substrate may be thermally conductive or thermally insulating. In some embodiments, ultrasonic or thermosonic wire bonding techniques may be used to electrically connect the chip to the flex substrate.

Figure 6:
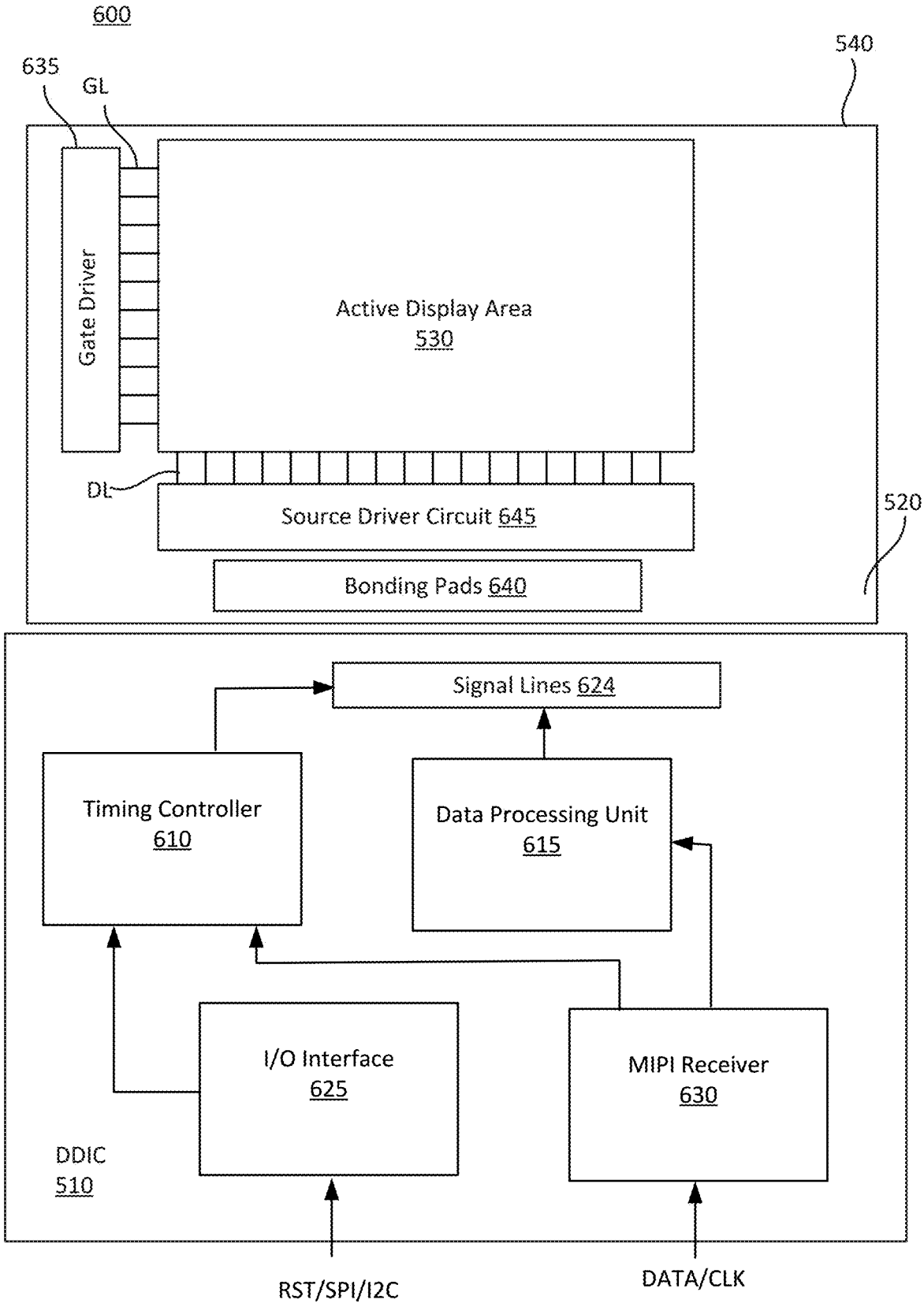
FIG. 6 is a schematic view of an OLED display device, according to some embodiments.

FIG. 6 is a schematic view of an OLED display device 600 according to some embodiments. The OLED display device 600 may include, among other components, the DDIC 510 and the display element 540. The display element 540 may be an integrated circuit including the backplane 520, the active display area 530, bonding pads 640, and a control circuit for controlling the active display area 530. The control circuit may include a source driver circuit 645 and a gate driver 635. The DDIC 510 may include a timing controller 610, a data processing circuit 615, an input/output (I/O) interface 620, a mobile industry processor interface (MIPI) receiver 625, and signal lines 624. In other embodiments, one or more components of the DDIC 510 may be disposed in the display element 540.

The timing controller 610 may be configured to generate timing control signals for the gate driver 635, the source driver circuit 645, and other components in the display element 540. The timing control signals may include one or more clock signals, a vertical synchronization signal, a horizontal synchronization signal, and a start pulse. However, timing control signals provided from the timing controller 610 according to embodiments of the present disclosure are not limited thereto.

The data processing unit 615 may be configured to receive image data DATA from the MIPI receiver 630 and convert the data format of the image data DATA to generate data signals input to the source driver circuit 645 for displaying images in the active display area 530.

The I/O interface 625 is a circuit that receives control signals from other sources and sends operation signals to the timing controller 610. The control signals may include a reset signal RST to reset the display element 540 and signals according to serial peripheral interface (SPI) or inter-integrated circuit (I2C) protocols for digital data transfer. Based on the received control signals, the I/O interface 625 may process commands from a system on a chip (SoC), a central processing unit (CPU), or other system control chip.

The MIPI receiver 630 may be a MIPI display serial interface (DSI), which may include a high-speed packet-based interface for delivering video data to the pixels in the active display area 530. The MIPI receiver 630 may receive image data DATA and clock signals CLK and provide timing control signals to the timing controller 610 and image data DATA to the data processing unit 615.

The active display area 530 may include a plurality of pixels arranged into rows and columns with each pixel including a plurality of subpixels (e.g., a red subpixel, a green subpixel, a blue subpixel). Each subpixel may be connected to a gate line GL and a data line DL and driven to emit light according to a data signal received through the connected data line DL when the connected gate line GL provides a gate-on signal to the subpixel. The active display area 530 may be divided into a focus area associated with focus rows of the pixels and a non-focus area associated with non-focus rows of the pixels. The focus rows of the pixels may be sandwiched between a first subset of the non-focus rows and a second subset of the non-focus rows. The focus rows are operated in a progressive scanning manner while the non-focus rows are operated in an interlaced scanning manner.

The backplane 520 may include conductive traces for electrically connecting the pixels in the active display area 530, the gate driver 635, the source driver circuit 645, and the bonding pads 640. The bonding pads 640 are conductive regions on the backplane 520 that are electrically coupled to the signal lines 624 of the DDIC 510 to receive timing control signals from the timing controller 610, and data signals from the data processing unit 615. The bonding pads 640 are connected to the source driver circuit 645, the gate driver 635, as well as other circuit elements in the backplane 520. In the embodiment illustrated in FIG. 6, the DDIC 510 generates data signals and timing control signals and transmits the signals to the bonding pads 640 of the display element 540. However, in other embodiments, the timing controller 610 and/or the data processing unit 615 may be in the display element 540 instead of the DDIC 510. When the timing controller 610 and/or the data processing unit 615 are on the display element 540, there may be fewer bonding pads 640 since the data signals and timing control signals may be directly transmitted to the corresponding component without a bonding pad 640.

The gate driver 635 may be connected to a plurality of gate lines GL and provide gate signals to the plurality of gate lines GL at appropriate times. The gate driver 635 includes a plurality of stages, where each stage is connected to a gate line GL that outputs gate signals to a row of pixels. First stages of the gate driver 635 operate the focus rows of the pixels in the active display area 530 in the progressive scanning manner, and second stages of the gate driver 635 operates the non-focus rows of the pixels in the active display area 530 in the interlaced scanning manner.

The source driver circuit 645 may receive data signals from the data processing unit 615 and provide the data signals to the active display area 530 via data lines DL. The source driver circuit 645 may include a plurality of source drivers, each source driver connected to a column of pixels via a data line DL. The source driver circuit 645 refreshes a first subset of data signals that are provided to first columns of the pixels associated with the focus area at a first rate and refresh a second subset of data signals that are provided to second columns of the pixels associated with the non-focus area that is less than the first rate. In some embodiments, the second rate is half of the first rate.

Figure 7:
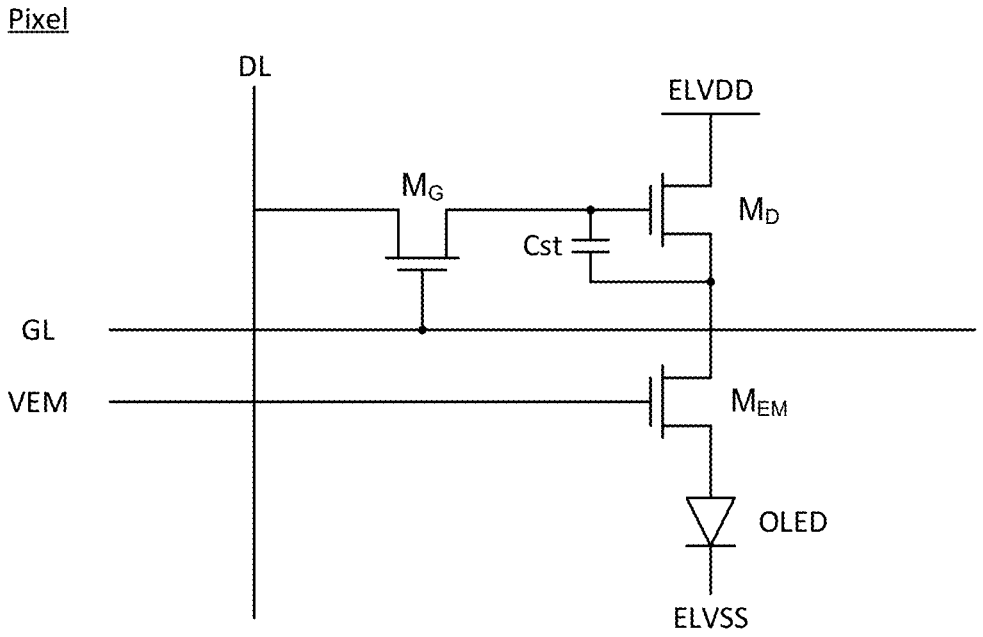
FIG. 7 illustrates an example OLED pixel structure, according to some embodiments.

FIG. 7 illustrates an example OLED pixel structure, according to some embodiments. The pixel includes a driving transistor $M_D$ that is configured to generate a current proportional to a voltage stored by the storage capacitor Cst for driving the OLED. The OLED then generates light that is proportional to an amount of current provided by the driving transistor $M_D$. Since the brightness of the pixel is proportional to the current being provided to the OLED, the amount of power consumed by the OLED is also proportional to the desired brightness of the OLED. That is, a display device 220 implemented using OLEDs consumes more power when displaying a brighter image compared to displaying a relatively darker image.

The gate transistor $M_G$ controls a connection between the gate terminal of the driving transistor $M_D$ and the data line DL. When the gate line GL provides a gate-on signal, the gate transistor $M_G$ turns on, connecting the gate terminal of the driving transistor $M_D$ to the data line DL and charging the storage capacitor Cst based on a voltage value of a data signal provided at the data line DL. When the gate line DL provides a gate-off, the gate transistor $M_G$ is turned off, disconnecting the gate terminal of the driving transistor $M_G$ from the data line DL. The emission transistor $M_{EM}$ controls a connection between the driving transistor $M_D$ and the OLED. When the emission signal VEM is asserted, the emission transistor $M_{EM}$ turns on, connecting the driving transistor $M_D$ to the OLED. When the driving transistor $M_D$ is connected to the OLED, the OLED is turned on. In some embodiments, the data line DL is shared by a set of pixels disposed in a same column of the display area 240. Moreover, the gate line GL is shared by a set of pixels disposed in a same row of the active display area 530. The pixel according to embodiments of the present disclosure are not limited to the structure illustrated in FIG. 7.

Figure 8:
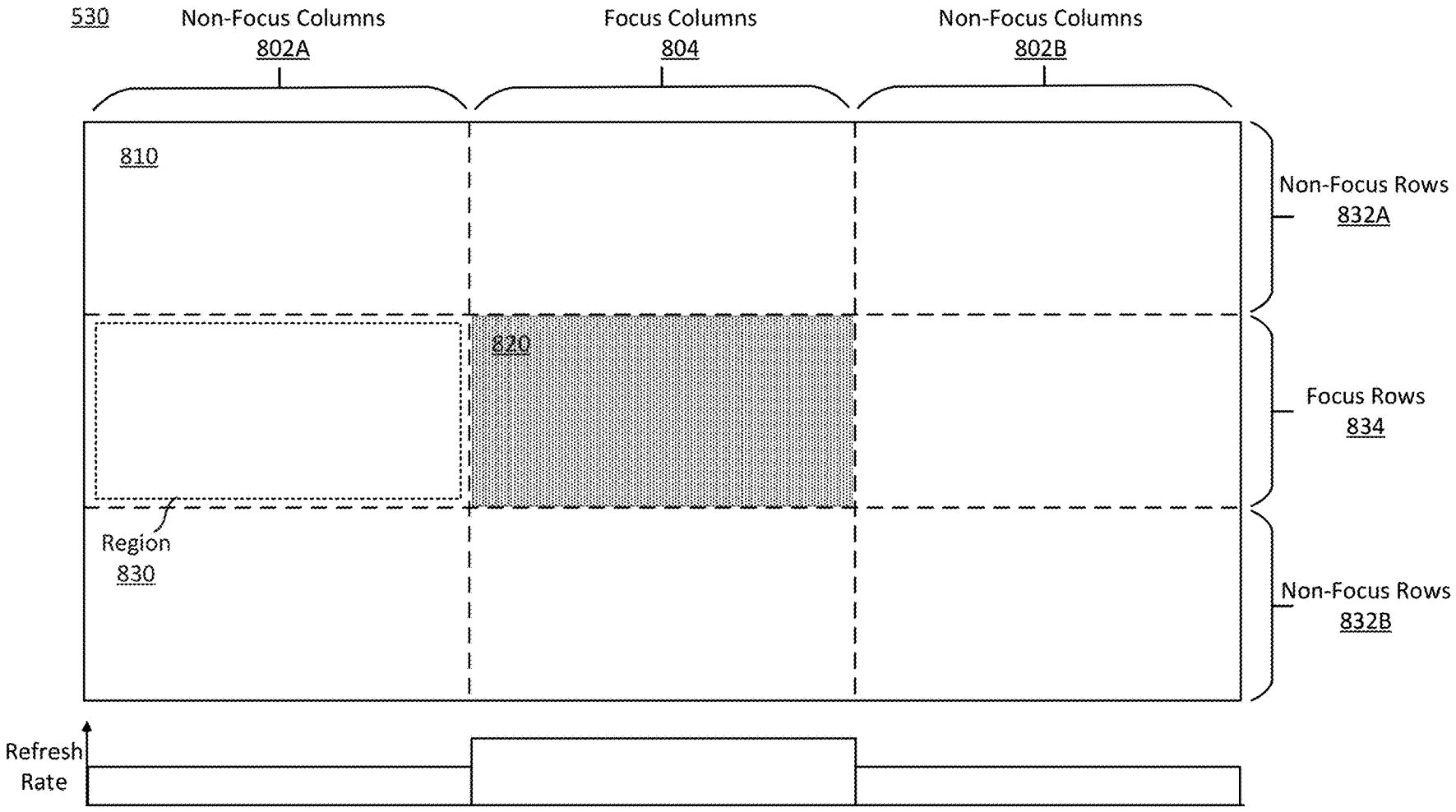
FIG. 8 is a schematic view of an active display area, according to some embodiments.

FIG. 8 is a schematic view of an active display area 530, according to some embodiments. The active display area 530 may be divided into a plurality of regions 830, each region 830 represented as a box. Each region 830 belongs to either a focus area 820 or a non-focus area 810. The focus area 820 corresponds to a portion of the active display area 530 that user's eyes are focused on, and the non-focus area 810 corresponds to a remaining portion of the active display area 530 that surround the focus area 820. Since users are more likely to focus on pixels in the center region than pixels in the peripheral region, the pixels in the center region may be fixed as the focus area 820. However, in some embodiments, the focus area 820 may be updated according to the movement of the user's eyes based on eye tracking information.

The active display area 530 includes a plurality of pixels arranged into rows and columns. Each row of pixels is connected to the gate driver 635 via a gate line GL, and each column of pixels is connected to a source driver of the source driver circuit 645 via a data line DL. Focus rows 834 include pixels in the focus area 820, and non-focus rows 832 do not include pixels in the focus area 820. A first subset of the non-focus rows 832A lie above the focus rows 834 and a second subset of the non-focus rows 832B lie below the focus rows 834. Similarly, focus columns 804 include pixels in the focus area 820, and non-focus columns 802 do not include pixels in the focus area 820. A first subset of the non-focus columns 802A lies to the left of the focus columns 804, and a second subset of the non-focus columns 802B lies to the right of the focus columns 804.

Since the human eye is more sensitive to pixels in the focus area 820 compared to the non-focus area 810, pixels in the non-focus area 810 may be operated at a lower resolution compared to pixels in the focus area 820 without users noticing a deterioration in image quality. Accordingly, the non-focus rows 832 are operated in an interlaced scanning manner, and the focus rows 834 are operated in a progressive scanning manner. Interlaced scanning involves displaying odd numbered rows of the non-focus rows 832 during odd display frames and displaying even numbered rows of the focus rows 834 during even display frames. That is, a pixel in the non-focus rows 832 emits light in every other display frame. In contrast, progressive scanning involves displaying even and odd numbered rows of the focus rows 834 in every display frame, and a pixel in the focus area 820 emits light in every display frame.

By using interlaced scanning manner for at least some of the rows, the frame rate can be increased since it takes a shorter period of time to complete scanning through the rows in the active display area 530 compared to using progressive scanning in all of the rows. Furthermore, the display device can allocate more time for charging capacitors of the pixels to the data voltage by leaving the gate transistor $M_G$ turned on for a longer period of time. The longer charging period can improve the image quality by allowing the capacitor to be charged properly to the data voltage.

As illustrated in the bar graph in FIG. 8, data signals provided to the non-focus columns 802 are refreshed at a slower rate compared to data signals provided to the focus columns 804. In some embodiments, the data signals for the non-focus columns 802 are refreshed at half the rate of the data signals for the focus columns 804.

Figure 9:
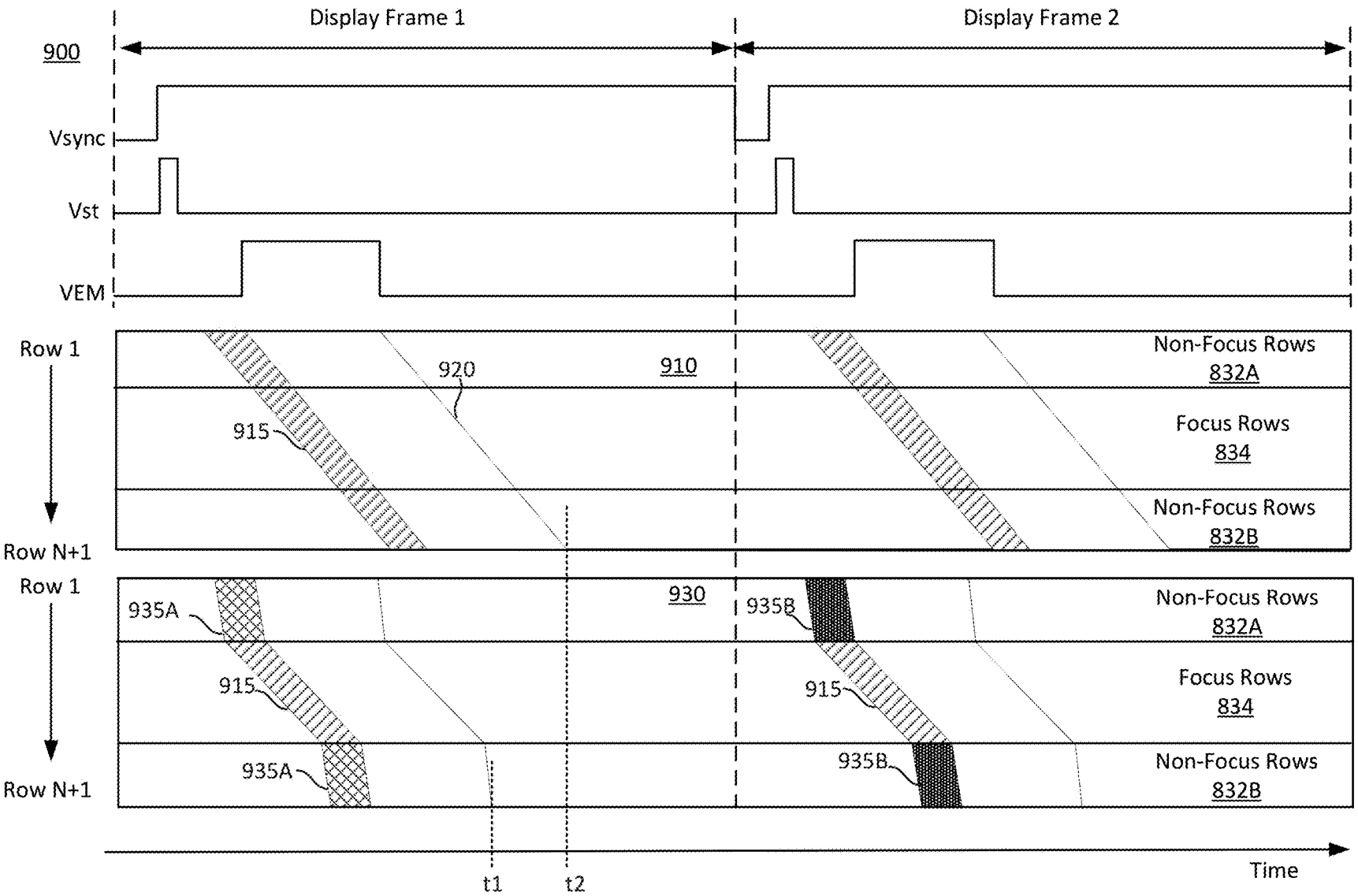
FIG. 9 is a timing diagram illustrating operation of an OLED display device, according to some embodiments.

FIG. 9 is a timing diagram 900 illustrating operation of an OLED display device 600, according to some embodiments. The timing diagram 900 includes a vertical synchronization signal Vsync, a start pulse Vst, and an emission signal VEM during frame 1, an odd display frame, and during frame 2, an even display frame.

A first diagram 910 illustrates operation of the OLED display device 600 according to a traditional driving scheme of using progressive scanning for all of row 1 through row N+1. The vertical synchronization signal Vsync synchronizes the start of the vertical scanning at the top of the active display area 530, and a first stage of the gate driver 635 outputs a first gate signal to a first gate line connected to a first row of pixels at the top of the active display area 530 to charge the first row of pixels with data voltage, according to progressive scanning 915. After the first row of pixels are charged, the emission signal VEM causes the first row of pixels (e.g, an odd numbered row) to emit light 920. When the first stage outputs the first gate signal to the first row of pixels, the first gate signal is also provided to a second stage that provide a second gate signal to operate a second row of pixels (e.g., an even numbered row) adjacent to the first row of pixels. Using the traditional driving scheme, the gate driver 635 operates both non-focus rows 832 and focus rows 834 using progressive scanning, and the display device 600 completes emitting light for a display frame at t2.

In contrast, a second diagram 930 illustrates the gate driving scheme of operating non-focus rows 832 using interlaced scanning 935 and operating focus rows 834 using progressive scanning 915. When interlaced scanning is used, only half of the non-focus rows 832 are scanned in a display frame. For example, in display frame 1, the odd numbered rows of the non-focus rows 832 are operated in the interlaced scanning manner 935A, and in display frame 2, the even numbered rows of the non-focus rows 832 are operated in the interlaced scanning manner 935B. Since fewer rows are being scanned in the gate driving scheme of 930 during a display frame compared to the traditional driving scheme of 910, the display device 600 completes emitting light for a display frame at t1 before t2. As a result, frame rate for operating the display device 600 may be increased compared to the traditional driving scheme.

Figure 10B:
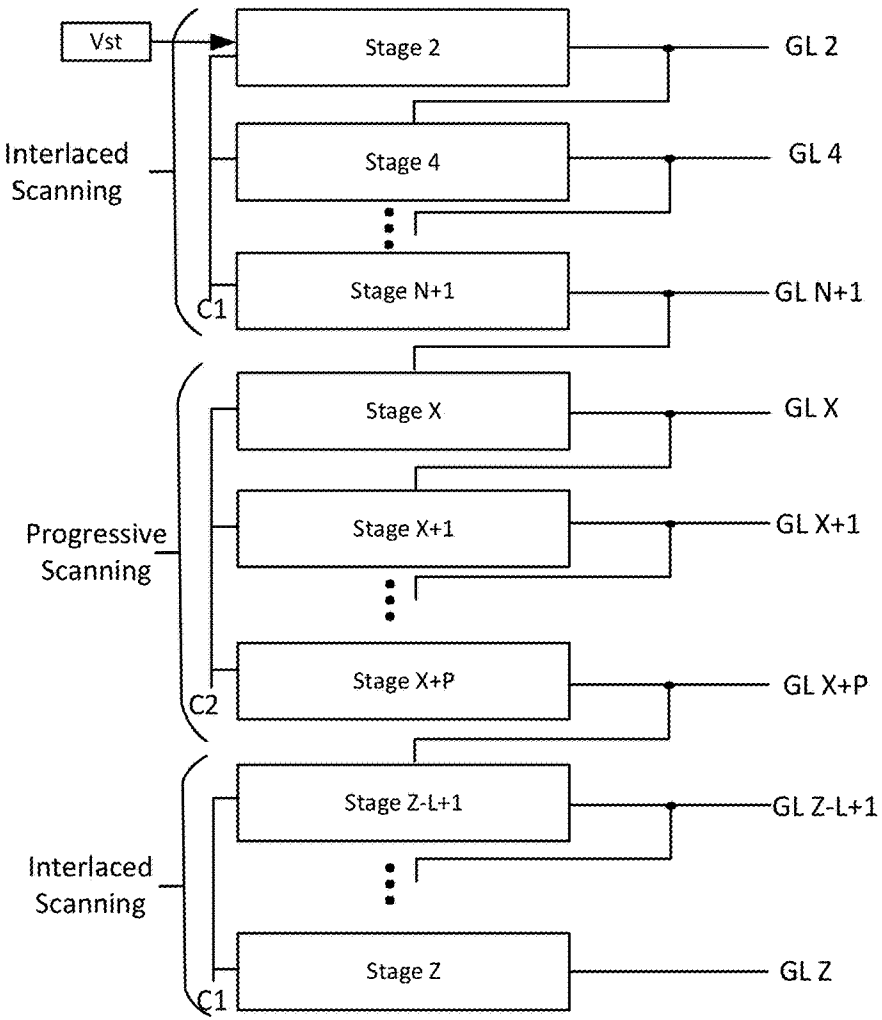
FIG. 10B is a diagram illustrating stage of a gate driver for driving even display frames, according to some embodiments.
Figure 10A:
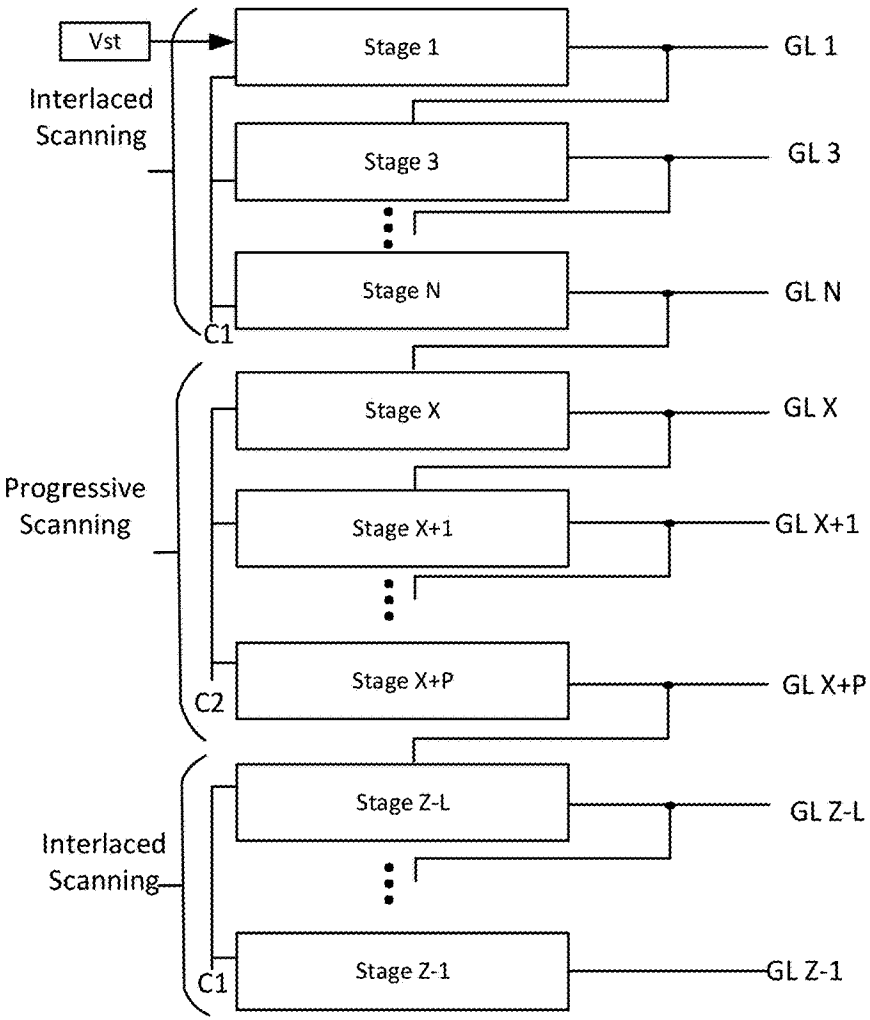
FIG. 10A is a diagram illustrating stages of a gate driver for driving odd display frames, according to some embodiments.

FIG. 10A is a diagram illustrating stages of a gate driver 635 for driving odd display frames, and FIG. 10B is a diagram illustrating stages of the gate driver 635 for driving even display frames, according to some embodiments. The gate driver 635 includes stage 1 through stage Z, where each stage outputs gate signals to a row of pixels via a corresponding gate line of GL 1 through GL Z. Referring back to the active display area 530 illustrated in FIG. 8, stage 1 through stage N+1 output gate signals to GL 1 through GL N+1 connected to the first subset of the non-focus rows 832A, stage X through stage X+P output gate signals to GL X through GL X+P connected to the focus rows 834, and stage Z−L through stage Z output gate signals to GL Z−L through GL Z connected to the second subset of the non-focus rows 832B. For simplicity, the even numbered stages of the non-focus rows 832 (e.g., stage 2, 4, . . . N+1, Z−L+1, Z−L+3, . . . Z) are not illustrated in FIG. 10A since they are not used during odd frame operations, and the odd numbered stages of the non-focus rows 832 (e.g., stage 1, 3, . . . N, Z−L, Z−L+2, . . . Z−1) are not illustrated in FIG. 10B since they are not used during even frame operations. However, the even numbered stages and the odd numbered stages may be in a single gate driver 635 and disposed such that an odd numbered stage is adjacent to at least one even numbered stage and vice versa.

As illustrated in FIG. 10A, during odd display frame operation, the first odd numbered stage (e.g., stage 1) of the gate driver 635 receives a start signal Vst that indicates the beginning of the scanning period. Responsive to receiving the start signal Vst, stage 1 outputs a first gate signal to GL1 connected to a first row of pixels of the display active area 530. The first gate signal is also provided as a carry signal to the next odd numbered stage (e.g., stage 3) which activates stage 3 to output a third gate signal to GL3 connected to a third row of pixels and to stage 5 as a carry signal. The odd numbered stages continue to output gate signals to the corresponding odd numbered GL and to the next odd numbered stage until the last odd numbered stage (e.g., stage N) of the first subset of the non-focus rows 832B outputs gate signals to GL N connected to an nth row of pixels. According to interlaced scanning, even numbered stages do not output gate signals and pixels in even numbered rows of the display active area 530 remain off.

The gate signals provided by stage N to GL N also operates as a carry signal for activating a first stage that operates in a progressive scanning manner (e.g., stage X) for scanning the first focus row 834. During odd display frames, stage X receives the carry signal from stage N, but during even display frames, stage X receives a carry signal from stage N+1. Stage X outputs a xth gate signal to GL X connected to row X of pixels of the focus rows 834. In some embodiments, a different carry signal (e.g., another timing control signal from the timing controller 610) may be provided to activate stage X. Assuming that stage X is an odd numbered stage, the xth gate signal is also provided as a carry signal to an even numbered stage X+1 adjacent to stage X. Responsive to receiving the carry signal, stage X+1 outputs a (x+1)th gate signal to a (x+1)th row of pixels, which is an even numbered row of pixels. Unlike the stages operating the non-focus rows 832 that skip the even stages during odd frames, the stages operating the focus rows 834 provide carry signals to its adjacent stage such that odd numbered rows of pixels and even numbered rows of pixels are operated within the same frame. The last stage that operates in the progressive scanning manner (e.g., stage X+P) outputs a (X+P)th gate signal that is provided as a carry signal to stage Z−L, the first odd numbered stage in a second subset of the non-focus rows 832B. In some embodiments, a different carry signal may be provided to stage Z−L instead of the (X+P)th gate signal.

Similar to the first subset of the non-focus rows 832A that lie above the focus rows 834, the odd numbered rows of pixels in the second subset of the non-focus rows 832B are operated by odd numbered stages during odd frames. Responsive to receiving the (X+P)th gate signal as the carry signal, stage Z−L outputs a (Z−L)th gate signal to GL Z−L that is also provided as carry signal to the next odd numbered stage Z−L+2. The odd numbered stages in the second subset of the non-focus rows 832B continue to provide gate signals and carry signals until the last odd numbered stage Z−1 outputs a (Z−1) gate signal, which completes the scanning for the odd frames. Stages operated in the interlaced scanning manner receive a first clock signal C1 associated with a first rate while stages operated in the progressive scanning manner receive a second clock signal C2 associated with a second rate faster than the first rate. In some embodiments, the first rate is half of the second rate.

Even frame operation illustrated in FIG. 10B is similar to odd frame operation illustrated in FIG. 10A, except that even numbered stages corresponding to the non-focus rows 832 output gate signals to operate even numbered rows of pixels in the display active area 530 while odd numbered stages do not operate. Description for even frame operation is omitted to avoid redundancy.

Figure 11:
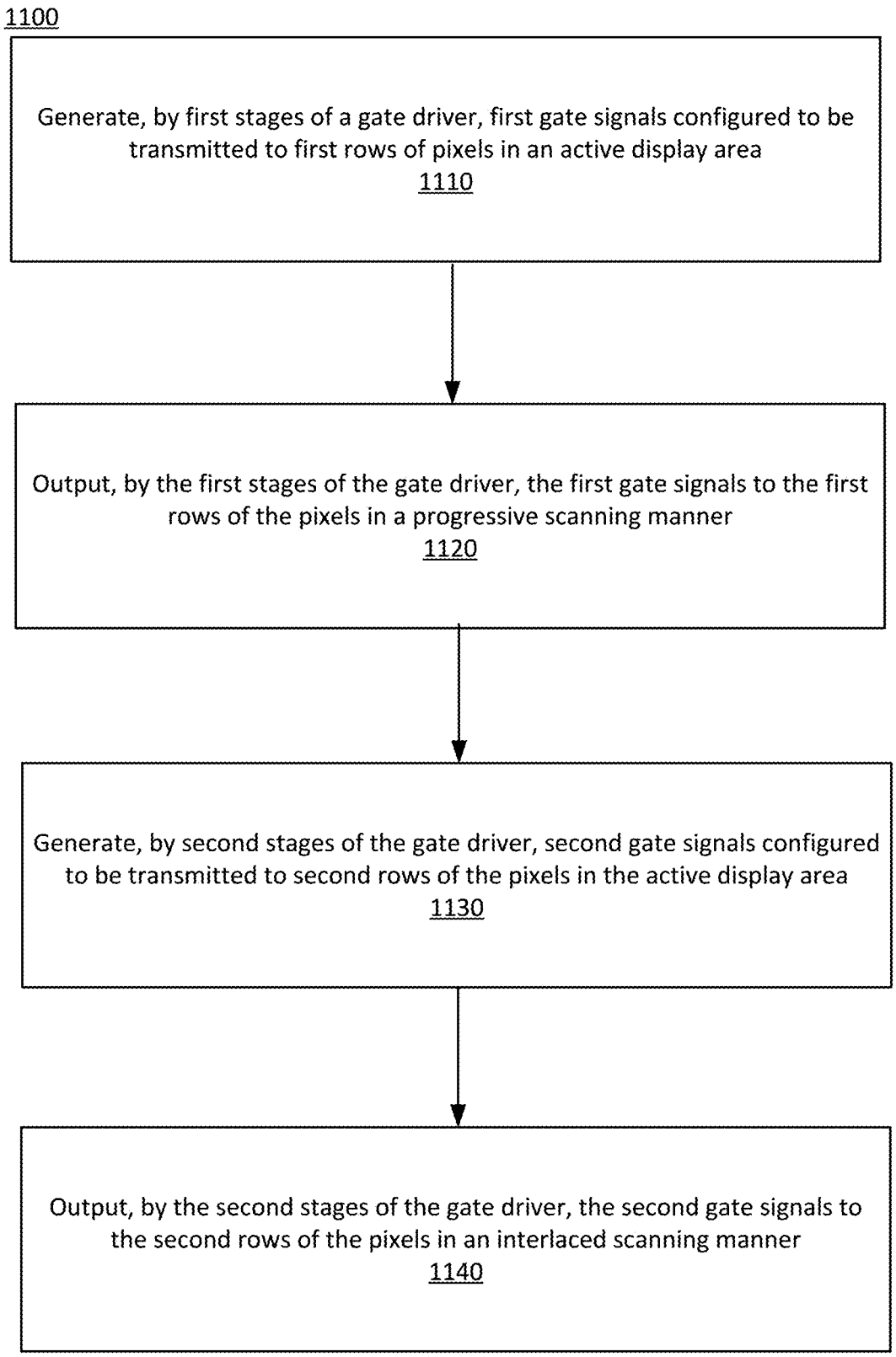
FIG. 11 is a flowchart illustrating an operation of an OLED display device, according to some embodiments.

FIG. 11 is a flowchart 1100 illustrating an operation of an OLED display device, according to some embodiments. The OLED display device includes a gate driver with a plurality of first stages and a plurality of second stages that supply gate signals to pixels in an active display area. The first stages of the gate driver generate 1110 first gate signals configured to be transmitted to first rows of pixels in an active display area of the OLED display device. The first stages of the gate driver output 1120 the first gate signals to the first rows of pixels in a progressive scanning manner. The first rows of pixels may be in a focus area of the active display area. The second stages of the gate driver generate 1130 second gate signals configured to be transmitted to second rows of pixels in the active display area. The second stages of the gate driver output 1140 the second gate signals to the second rows of pixels according in an interlaced scanning manner. The second rows of pixels may be in a non-focus area of the active display area that surround the focus area.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A display device comprising:

an active display area comprising pixels arranged in rows and columns;

a source driver circuit configured to supply data signals to the pixels; and a gate driver circuit coupled to gate lines to supply gate signals to the pixels, the gate driver comprising:

first stages configured to output first gates signals to first rows of the pixels in a progressive scanning manner using a first clock signal at a first rate, and second stages configured to output second gate signals to second rows of the pixels in an interlaced scanning manner using a second clock signal at a second rate that is slower than the first rate.

2. The display device of claim 1, wherein the active display area is divided into a focus area and a non-focus area, wherein the first rows of the pixels are in the focus area and the second rows of the pixels are in the non-focus area.

3. The display device of claim 1, wherein a stage of the first stages is configured to output a gate signal that operates an odd numbered row of the pixels and operates as a carry signal for activating a next stage of the first stages, the next stage configured to output another gate signal that operates an even numbered row of the pixels adjacent to the odd numbered row of the pixels.

4. The display device of claim 3, wherein one stage of the second stages is configured to output a gate signal as a carry signal to activate one of the first stages in an even display frame, and another stage of the second stages is configured to output another gate signal as a carry signal to activate the one of the first stages in an odd display frame.

5. The display device of claim 3, wherein a last stage of the first stages is configured to output a gate signal that operates as a carry signal for activating a stage in the second stages.

6. The display device of claim 1, wherein the first stages are sandwiched between a first subset of the second stages and a second subset of the second stages, the first subset of the second stages configured to operate a first subset of the second rows of the pixels, the first stages configured to operate the first rows of the pixels below the first subset of the second rows of the pixels, and the second subset of the second stages configured to operate a second subset of the second rows of the pixels below the first rows of the pixels.

7. The display device of claim 1, wherein the second rate is half the first rate.

8. The display device of claim 1, wherein the source driver circuit is configured to refresh a first subset of data signals to first columns of the pixels at a first rate, and refresh a second subset of data signals to second columns of the pixels at a second rate that is half of the first rate.

9. The display device of claim 8, wherein the first columns of the pixels are sandwiched between a first subset of the second columns and a second subset of the second columns.

10. A gate driver comprising:

first stages configured to output first gates signals to first rows of pixels in an active display area via first gate lines in a progressive scanning manner using a first clock signal at a first rate, and second stages configured to output second gate signals to second rows of the pixels in the active display area via second gate lines in an interlaced scanning manner using a second clock signal at a second rate that is slower than the first rate.

11. The gate driver of claim 10, wherein the first rows of the pixels are in a focus area of the active display area and the second rows of the pixels are in a non-focus area of the active display area.

12. The gate driver of claim 10, wherein a stage of the first stages is configured to output a gate signal that operates an odd numbered row of the pixels and operates as a carry signal for activating a next stage of the first stages, the next stage configured to output another gate signal that operates an even numbered row of the pixels adjacent to the odd numbered row of the pixels.

13. The gate driver of claim 10, wherein one stage of the second stages is configured to output a gate signal as a carry signal to activate one of the first stages in an even display frame, and another stage of the second stages is configured to output another gate signal as a carry signal to activate the one of the first stages in an odd display frame.

14. The gate driver of claim 13, wherein a last stage of the first stages is configured to output a gate signal that operates as a carry signal for activating a stage in the second stages.

15. The gate driver of claim 10, wherein the first stages are sandwiched between a first subset of the second stages and a second subset of the second stages, the first subset of the second stages configured to operate a first subset of the second rows of the pixels, the first stages configured to operate the first rows of the pixels below the first subset of the second rows of pixels, and the second subset of the second stages configured to operate a second subset of the second rows of the pixels below the first rows of the pixels.

16. The gate driver of claim 10, wherein the second rate that is half the first rate.

17. A method comprising:

generating, by first stages of a gate driver, first gate signals configured to be transmitted to first rows of pixels in an active display area using a first clock signal at a first rate;

outputting, by the first stages of the gate driver, the first gate signals to the first rows of the pixels in a progressive scanning manner;

generating, by second stages of the gate driver, second gate signals configured to be transmitted to second rows of the pixels in the active display area using a second clock signal at a second rate that is slower than the first rate; and outputting, by the second stages of the gate driver, the second gate signals to the second rows of the pixels in an interlaced scanning manner.

18. The method of claim 17, wherein the first rows of the pixels are in a focus area of the active display area and the second rows of the pixels are in a non-focus area of the active display area.

19. The method of claim 17, wherein a stage of the first stages outputs a gate signal that operates an odd numbered row of pixels and operates as a carry signal for activating a next stage of the first stages, and wherein the next stage outputs another gate signal that operates an even numbered row of pixels adjacent to the odd numbered row of pixels.

20. The method of claim 17, wherein the first stages are sandwiched between a first subset of the second stages and a second subset of the second stages, the first subset of the second stages operating a first subset of the second rows of the pixels, the first stages operating the first rows of the pixels below the first subset of the second rows of pixels, and the second subset of the second stages operating a second subset of the second rows of the pixels below the first rows of the pixels.

* * * * *